US011958667B2

(12) United States Patent
Ludewig

(10) Patent No.: US 11,958,667 B2
(45) Date of Patent: Apr. 16, 2024

(54) CHILD RESISTANT PACKAGE WITH MULTIPLE STORAGE COMPARTMENTS

(71) Applicant: Jason W. Ludewig, Rockford, IL (US)

(72) Inventor: Jason W. Ludewig, Rockford, IL (US)

(73) Assignee: J.L. Clark LLC, Rockford, IL (US)

( * ) Notice: Subject to any disclaimer, the term of this patent is extended or adjusted under 35 U.S.C. 154(b) by 497 days.

(21) Appl. No.: 17/201,490

(22) Filed: Mar. 15, 2021

(65) Prior Publication Data

US 2021/0300640 A1 Sep. 30, 2021

Related U.S. Application Data

(60) Provisional application No. 63/002,107, filed on Mar. 30, 2020.

(51) Int. Cl.
*B65D 50/04* (2006.01)
*B65D 43/16* (2006.01)
*B65D 77/04* (2006.01)

(52) U.S. Cl.
CPC ..... *B65D 50/046* (2013.01); *B65D 43/162* (2013.01); *B65D 77/046* (2013.01)

(58) Field of Classification Search
CPC .. B65D 50/046; B65D 43/161; B65D 43/162; B65D 43/164; B65D 43/166; B65D 21/083
USPC ..... 220/521, 522, 259.2
See application file for complete search history.

(56) References Cited

U.S. PATENT DOCUMENTS

| | | | | |
|---|---|---|---|---|
| 2,737,311 | A | 3/1956 | Blacher | |
| 3,334,714 | A | 8/1967 | Gordon | |
| 3,490,746 | A | 1/1970 | Bell, III | |
| 3,944,105 | A | 3/1976 | Chollet | |
| 4,351,165 | A | 9/1982 | Gottsegen et al. | |
| 4,452,373 | A | 6/1984 | Pearce et al. | |
| 4,546,874 | A | 10/1985 | Kirchhan | |
| 4,563,381 | A | 1/1986 | Woodland | |
| 4,905,861 | A | 3/1990 | Boxall et al. | |
| 5,069,354 | A | 12/1991 | Tannebaum | |
| 5,211,302 | A | 5/1993 | Tiramani | |
| 5,676,272 | A | 10/1997 | Baerenwald | |
| 5,782,371 | A | 7/1998 | Baerenwald et al. | |
| 5,794,814 | A | 8/1998 | Baerenwald | |
| 5,855,766 | A | 1/1999 | Mamiye et al. | |
| 5,975,334 | A * | 11/1999 | Mayo | A45C 11/20 220/592.2 |
| 6,321,925 | B1 * | 11/2001 | Crouse | B65D 21/083 220/4.27 |
| 6,772,905 | B2 | 8/2004 | Cheng | |

(Continued)

*Primary Examiner* — Jeffrey R Allen
(74) *Attorney, Agent, or Firm* — Reinhart Boerner Van Deuren P.C.

(57) ABSTRACT

A container including a lid, a first body, a second body and a latch is provided. The first body connects to the lid by a first hinge for pivoting between a lid closed position and a lid open position. The first body defines a storage cavity. The second body connects to the first body by a second hinge for pivoting the first body relative to the second body between a first body closed position and a first body open position. The second body defines a storage cavity. The latch is attached to the second body. The latch is transitionable between a latched position in which the latch engages the lid and prevents transitioning either the lid or the first body to the corresponding open positions.

17 Claims, 11 Drawing Sheets

(56) References Cited

U.S. PATENT DOCUMENTS

| | | | | |
|---|---|---|---|---|
| 7,047,576 | B2 | 5/2006 | Tavivian | |
| 7,968,132 | B2 * | 6/2011 | Archie, Jr. | A45C 11/20 206/541 |
| 8,485,390 | B2 | 7/2013 | Cronin | |
| 8,915,358 | B2 * | 12/2014 | Johnson | B65D 43/18 220/264 |
| 10,611,549 | B1 * | 4/2020 | Mahon | B65D 1/24 |
| 2001/0035424 | A1 | 11/2001 | Combe et al. | |
| 2020/0095009 | A1 * | 3/2020 | Allers | B65D 21/0233 |

* cited by examiner

CHILD RESISTANT PACKAGE WITH MULTIPLE STORAGE COMPARTMENTS

CROSS-REFERENCE TO RELATED PATENT APPLICATIONS

This patent application claims the benefit of U.S. Provisional Patent Application No. 63/002,107, filed Mar. 30, 2020, the entire teachings and disclosure of which are incorporated herein by reference thereto.

FIELD OF THE DISCLOSURE

This present disclosure generally relates to containers and particularly containers for storing products that have multiple containers.

BACKGROUND

Some consumer products such as packets of tobacco or gum have waste after being fully consumed, e.g. the left over packet of tobacco or chewed up gum. In some instances, when the user is done using the product, the user may not have the ability to dispose of the left over waste. However, as these types of product are typically moist once fully consumed, it is not desirable to directly put the waste in one's pocket. Additionally, in the case of gum, the gum can be sticky and be irremovably matted into the material forming the pocket.

It is often desirable to have containers for storing various objects be child resistant. This feature is used to prevent children from accidentally coming into contact with and particularly ingesting the contents of the containers. For example, containers for things such as smokeless tobacco, medicine (e.g. nicotine gum), or other objects are often child resistant.

One test that determines whether a container is considered child resistant is if opening the container requires a multi-step process. For instance, some child resistant containers have threaded lids that require a two-step process to remove the threaded lid from the container bottom. The two-step process requires first axially pressing the threaded lid toward the container bottom and then second rotationally twisting the threaded lid relative to the container bottom. Accordingly, with such containers, the first step is axially pressing and the second step is rotationally twisting (i.e. unthreading). Containers for other products may contain products, for example paper, with liquids absorbed thereon. The two-step opening process prevents one single action from inadvertently opening such containers and mistakenly spilling the contents. Accordingly, a user of the container can safely and securely store the product in such multi-step opening containers until they reach a proper trash receptacle.

There are needs for improvements over the current state of the art.

SUMMARY

The present application provides a new and improved container. More particularly, the present application provides a new and improved container having multiple storage cavities.

In one example, a container including a lid, a first container body, a second container body, and a first latch is provided. The first container body connects to the lid by a first hinge for pivoting the lid relative to the first container body between a lid closed position relative to the first container body and a lid open position relative to the first container body. The first container body defines a first storage cavity. The second container body connects to the first container body by a second hinge for pivoting the first container body relative to the second container body between a first container body closed position relative to the second container body and a first container body open position relative to the second container body. The second container body defines a second storage cavity. The first latch is attached to the second container body. The first latch is transitionable between a latched position in which the latch engages the lid and prevents pivoting of the lid about the first hinge or the first container body about the second hinge and an unlatched position in which the first latch is disengaged from the lid such that the first latch does not prevent the lid from pivoting relative to the first container body and such that the first latch does not prevent the first container body from pivoting relative to the second container body.

In one example, the first and second hinges are parallel to one another and transversely spaced apart.

In one example, the lid includes a plastic hinge ring and a metal cover snap attached to the plastic hinge ring. The first and second container bodies are formed from plastic. The first and second container bodies, the first and second hinges, and the plastic hinge ring are formed from a single continuous piece of plastic.

In one example, a first catch arrangement is positioned between the lid and the first container body securing the lid in the closed position relative to the first container body when the first latch is in the unlatched position. The first catch arrangement is disengageable by a user pressing on the lid and providing an angular torque about the first hinge. A second catch arrangement is positioned between the first container body and the second container body securing the first container body in the closed position relative to the second container body when the first latch is in the unlatched position. The second catch arrangement is disengageable by a user pressing on the first container body and providing an angular torque about the second hinge.

In one example, the first latch provides a greater latching force when in the latched position than the first catch arrangement provides between the lid and the first container body. The first latch provides a greater latching force when in the latched position than the second catch arrangement provides between the first container body and the second container body.

In one example, the first catch arrangement is a snap engaging catch arrangement and the second catch arrangement is a snap engaging catch arrangement. In this configuration, the catch arrangements resiliently flex to engage and disengage.

In one example, when the first container body is in the closed position relative to the second container body, access to the second storage cavity is prohibited by the first container body if the lid is in the open or closed positions.

In one example, the first storage cavity has a smaller volume than the second storage cavity.

In one example, the lid includes a first annular sidewall. The first container body includes a second annular sidewall. The second container body includes a third annular sidewall. At least a portion of the second annular sidewall extends into the first annular sidewall when the lid is in the closed position relative to the first container body. At least a portion of the third annular sidewall extends into the second annular sidewall when the first container body is in the closed position relative to the second container body.

In one example, the lid includes a lid top. The first annular sidewall extends outward from the lid top. The first container body includes a first top wall. The second annular sidewall extends outward from the top wall. The first top wall includes a recess forming the first storage cavity. The second container body includes a bottom wall. The third annular sidewall extends outward from the bottom wall. The bottom wall and third annular sidewall define the second storage cavity.

In one example, the first latch is formed as a continuous piece of material with the second container body and the first latch resiliently flexes relative to the second container body to transition between the latched and unlatched positions.

In one example, the first latch moves generally parallel to the first and second hinges when transitioning between the latched and unlatched positions.

In one example, a second latch being substantially identical to the first latch is provided. The first and second latches being moved towards one another to transition the first and second latches to the unlatched positions thereof from the latched positions.

In one example, the second annular sidewall has an opening therethrough. The latch extends through the opening in the latched position to engage the lid.

In one example, the metal cover has an annular sidewall terminating in a curled end. The latch engages the curled end in the latched position. The curled end engages a catch of the plastic hinge ring to snap engage the metal cover to the plastic hinge ring.

In one example, a method of using a container as outlined above is provided. The method includes transitioning the latch to the unlatched position. The method includes pivoting the lid relative to the first container body to the open position relative to the first container body from the closed position relative to the first container body or pivoting the first container body to the open position relative to the second container body from the closed position relative to the second container body.

In one example, a method of using a container as outlined above is provided. The method includes transitioning the latch to the unlatched position. The method includes pivoting the lid relative to the first container body to the open position relative to the first container body from the closed position relative to the first container body when the first container body is in the closed position relative to the second container body. The method includes pivoting the first container body to the open position relative to the second container body from the closed position relative to the second container body when the lid is in the closed position relative to the first container body.

Other aspects, objectives, and advantages of the present disclosure will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present disclosure and, together with the description, serve to explain the principles of the disclosure. In the drawings.

While the present disclosure will be described in connection with certain examples, there is no intent to limit the present disclosure to those examples. On the contrary, the intent is to cover all alternatives, modifications and equivalents as included within the spirit and scope of the present disclosure as defined by the appended claims.

DETAILED DESCRIPTION

Figure 1:
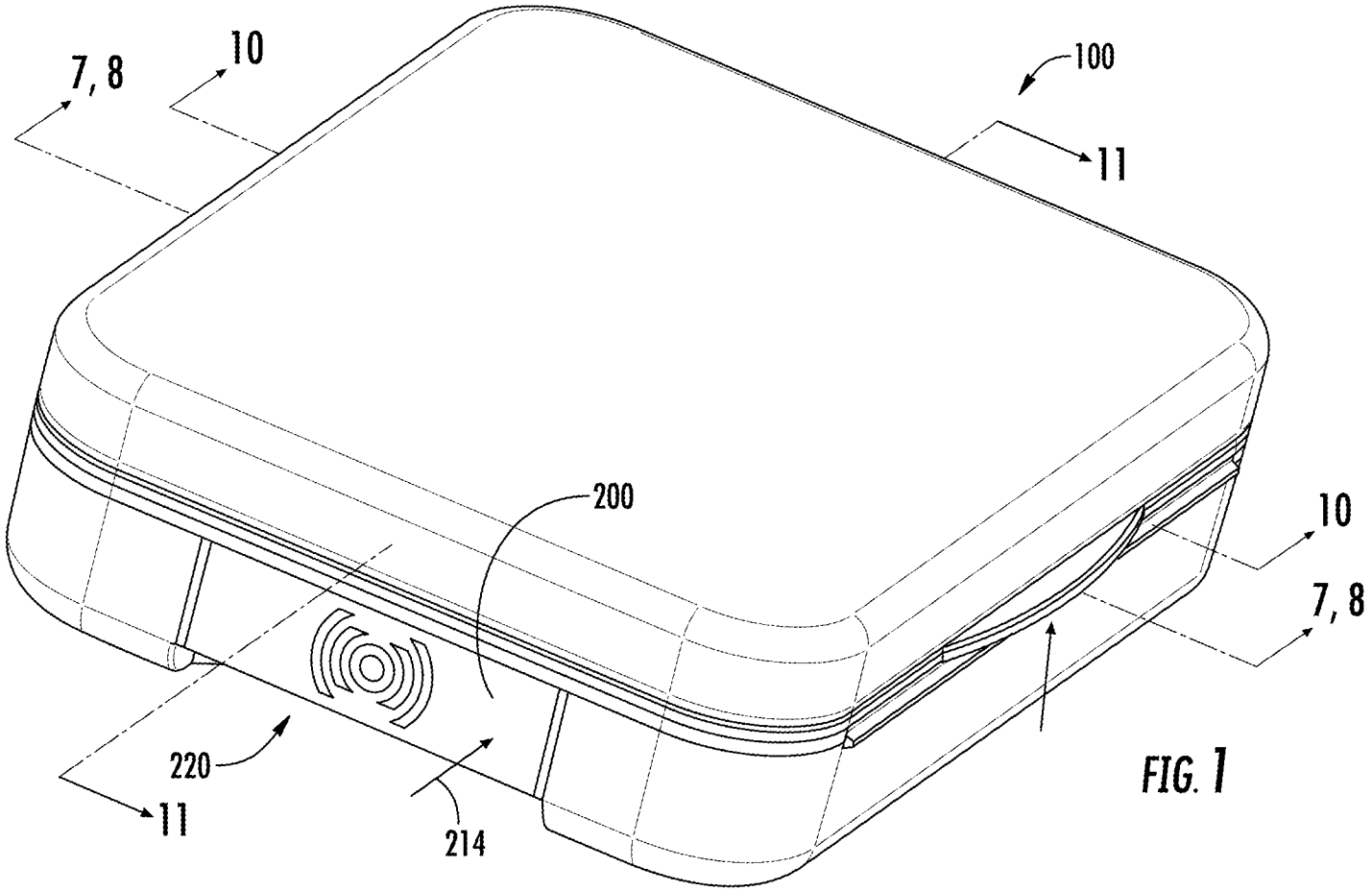
FIGS. 1 and 2 are top isometric illustrations of a container according to one example of the present disclosure.
Figure 2:
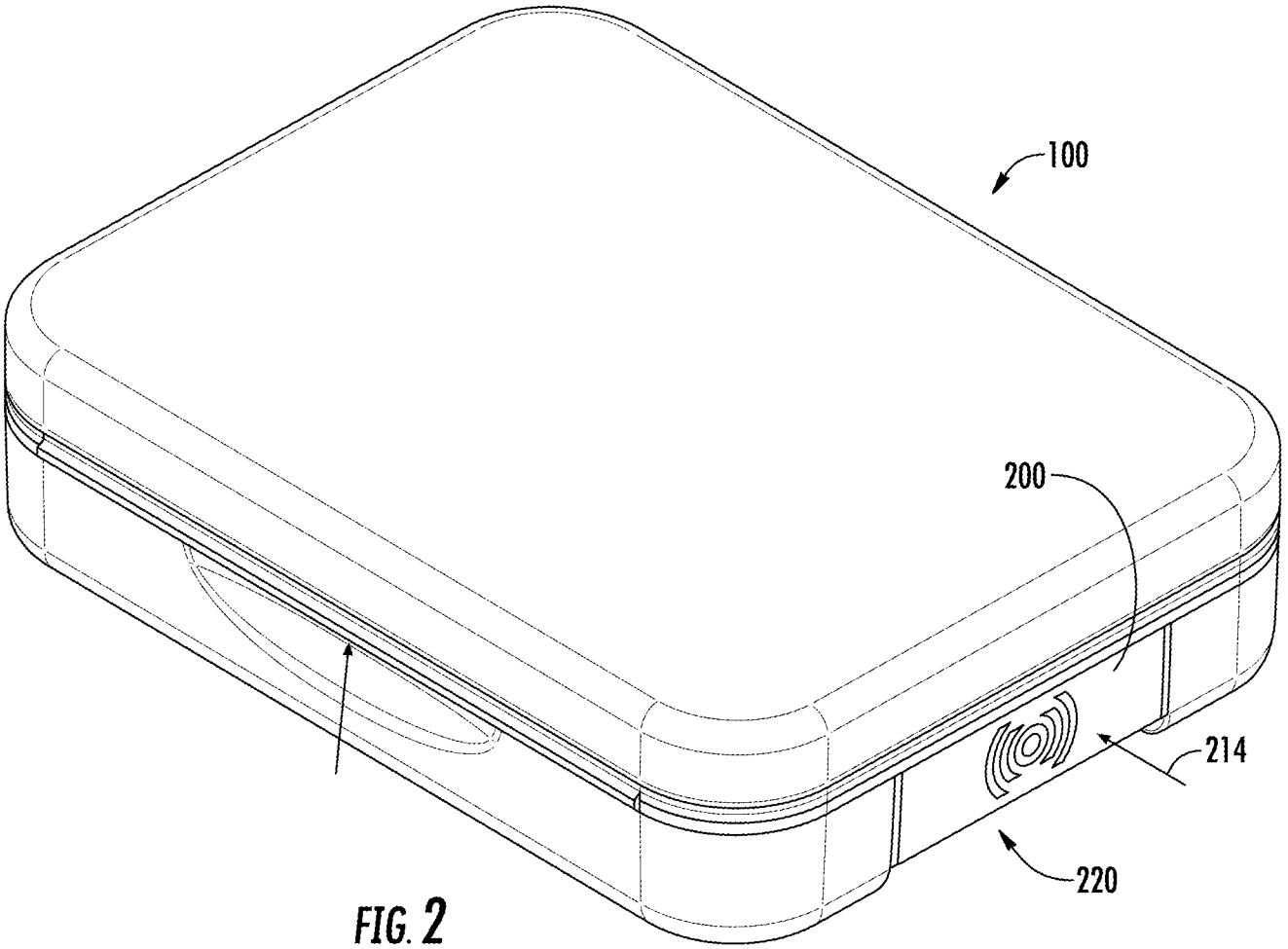

FIGS. 1 and 2 illustrate one example of a container 100 according to aspects of the present disclosure. The container 100 has multiple storage locations and is configured to store product to be used by a consumer and then to also be able to store waste after the product is used. For example, the container finds particular use in storing smokeless tobacco packets such as snus or gum. These two products typically have waste once the product has reached its useful life (e.g. when it runs out of flavor). However, the waste is not something that most people would simply put in a pocket as it has been in their mouth and may have a level of moisture.

The container 100 may also be considered child resistant. As will be described, the user must perform multiple operations to open the container 100.

Figure 3:
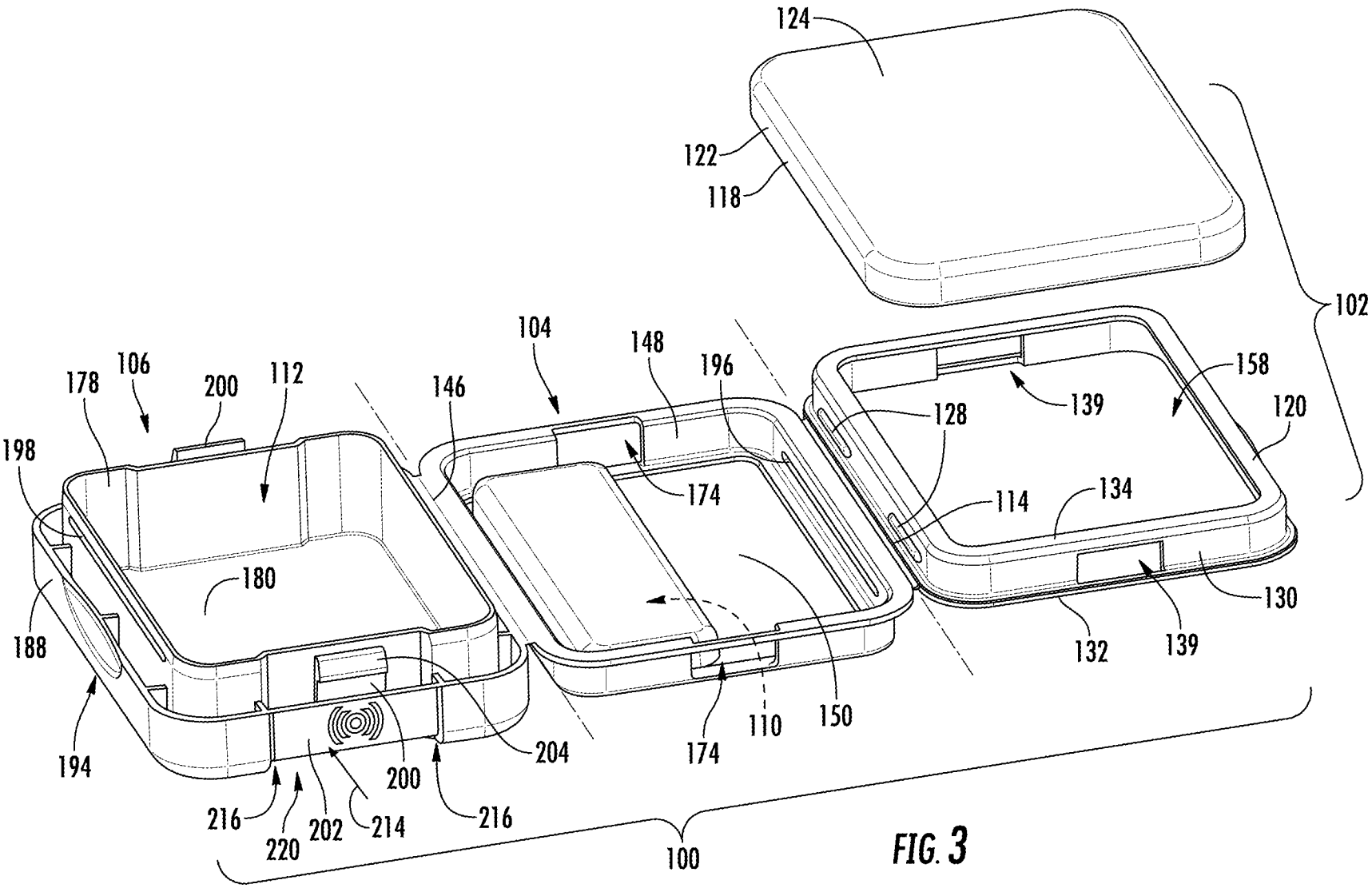
FIGS. 3 and 4 are exploded illustrations of the container of FIGS. 1 and 2, with the hinge ring, first container body and second container body illustrated in an as molded orientation.
Figure 4:
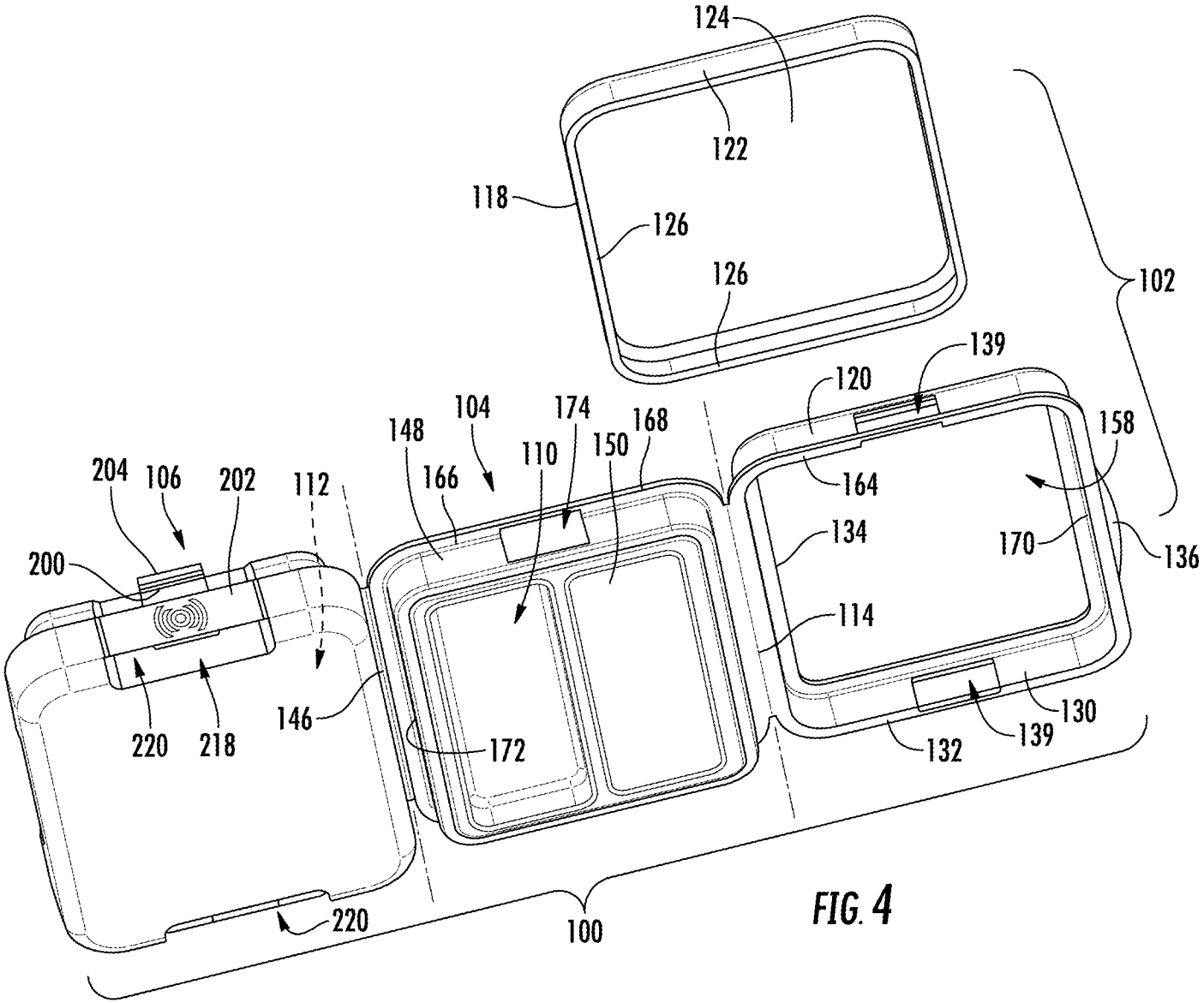

With reference to FIGS. 3 and 4, the container 100 has a plurality of portions including a lid 102, a first container body 104, and a second container body 106. The lid 102, the first container body 104, and the second container body 106 cooperate to define storage compartments in the form of a first storage cavity 110 and a second storage cavity 112.

The lid 102 is connected to the first container body 104 by a first hinge 114. The lid 102 in this example is a multi-component portion of the container. The lid 102 includes a lid cover 118 connected to a hinge ring 120. In one example, the lid cover 118 is metal and the hinge ring 120 is plastic. In other examples, the lid cover 118 and the hinge ring 120 may be made of different materials.

In the illustrated example, the lid cover 118 and the hinge ring 120 snap engage one another. In this example, the lid cover 118 includes an annular sidewall 122 that extends from a lid top 124. The lid top 124 and the annular sidewall 122 are formed from a continuous piece of metal and a stamped metal. In this example, the annular sidewall 122 terminates in an inward directed curl 126 (see FIG. 4). The inward directed curl 126 provides a first abutment that cooperates with the outward extending catches/abutments 128 (see FIGS. 3 and 7) of the hinge ring 120 to connect the two components together. Again, the connection may be a snap fit connection in which the components resiliently flex as the lid cover 118 is attached to the hinge ring 120.

The hinge ring 120 includes an annular sidewall 130 that has an outward extending flange 132 at an end thereof and an inward extending flange 134 at an opposite end thereof. These flanges provide rigidity to the annular sidewall 130. A top surface of the outward extending flange 132 also provides a shelf against which an outer portion of curl 126 can axially rest when the lid cover 118 is attached to the hinge ring.

In an example, an outer edge of flange 132 has a substantially same peripheral shape and size as the outer surface of the outer periphery defined by the outer surface of the annular sidewall 130.

The hinge ring 120 includes an outward extending projection that forms a finger tab 136 that a user can engage to help open the lid 102.

The annular sidewall 130 has a pair of openings 139 formed in opposed sides thereof. The openings 139 are sized and positioned to expose a portion of the curl 126 formed at the distal end of annular sidewall 122 when the lid cover 118 is attached to the hinge ring 120.

Figure 5:
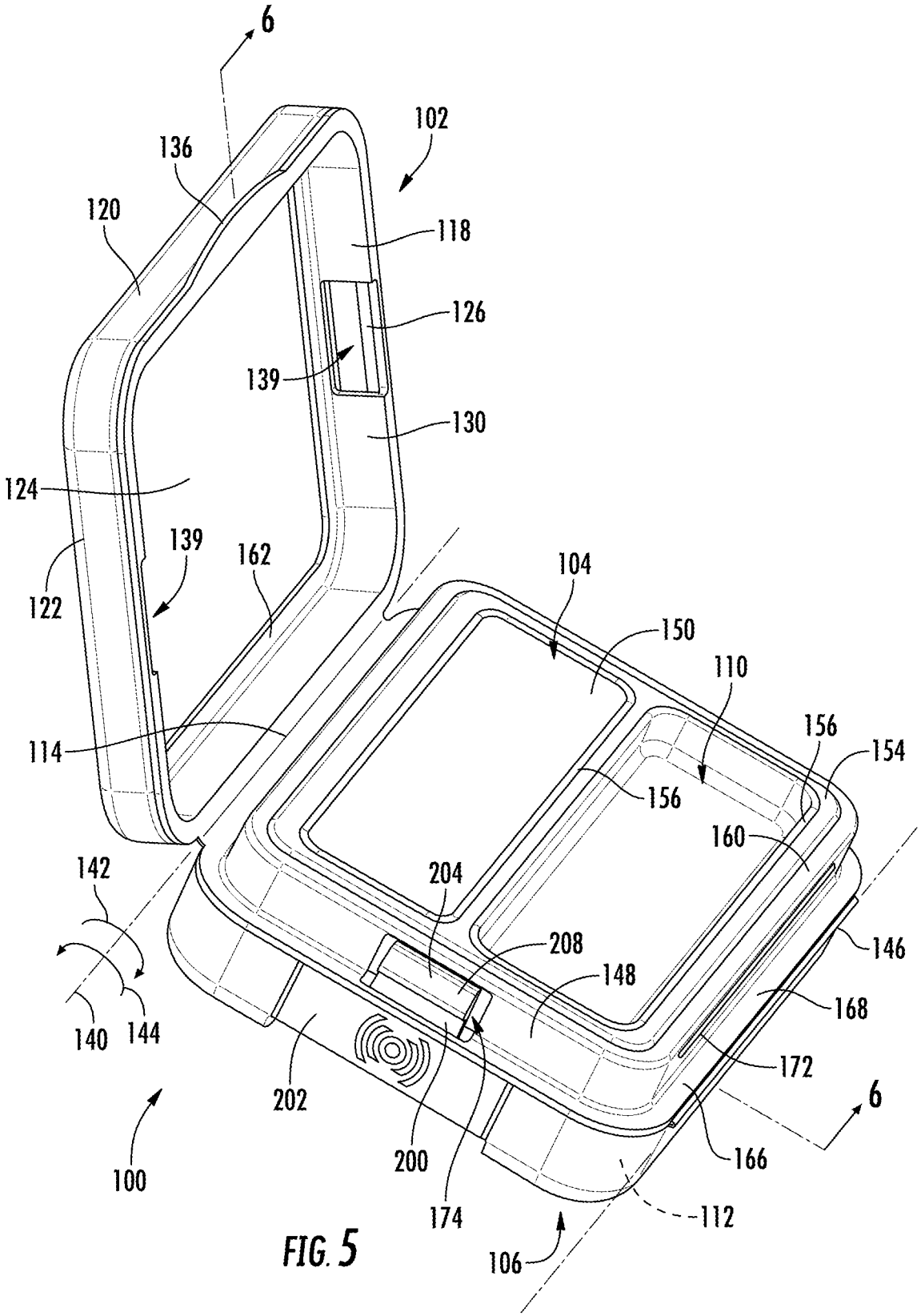
FIG. 5 is a top isometric illustration of the container of FIGS. 1 and 2 with the lid in an open position relative to the first container body.

In FIG. 5, the lid 102 is in an open position relative to the first container body 104. The lid 102 has been pivoted about the first hinge 114 and the rotational axis 140 defined thereby. More particularly, a user has pivoted the lid 102 in a direction illustrated by arrow 144. To transition the lid 102 to the closed position (e.g. FIGS. 1 and 2), the user can pivot the lid 102 via the hinge 114 about an axis 140 in an opposite direction illustrated by arrow 142.

The first container body 104 is an intermediate component formed between the hinge ring 118 and the second container body 106. The first container body 104, in this example, is formed as a continuous piece of material with the second container body 106. In such an example, both components may be formed from plastic, such as molded plastic. The connection between the first container body 104 and second container body 106 is provided by a second hinge 146.

The first container body 104 includes an annular sidewall 148 and a top wall 150. The annular sidewall 148 extends outward from a top wall 150. The top wall 150 includes a recessed region that defines the first storage cavity 110 therein. In this example, the storage cavity 110 only takes up about 50% of the surface area of the top wall 150. However, in other examples the storage cavity 110 may be a larger or smaller portion of the top wall 150.

Figure 7:
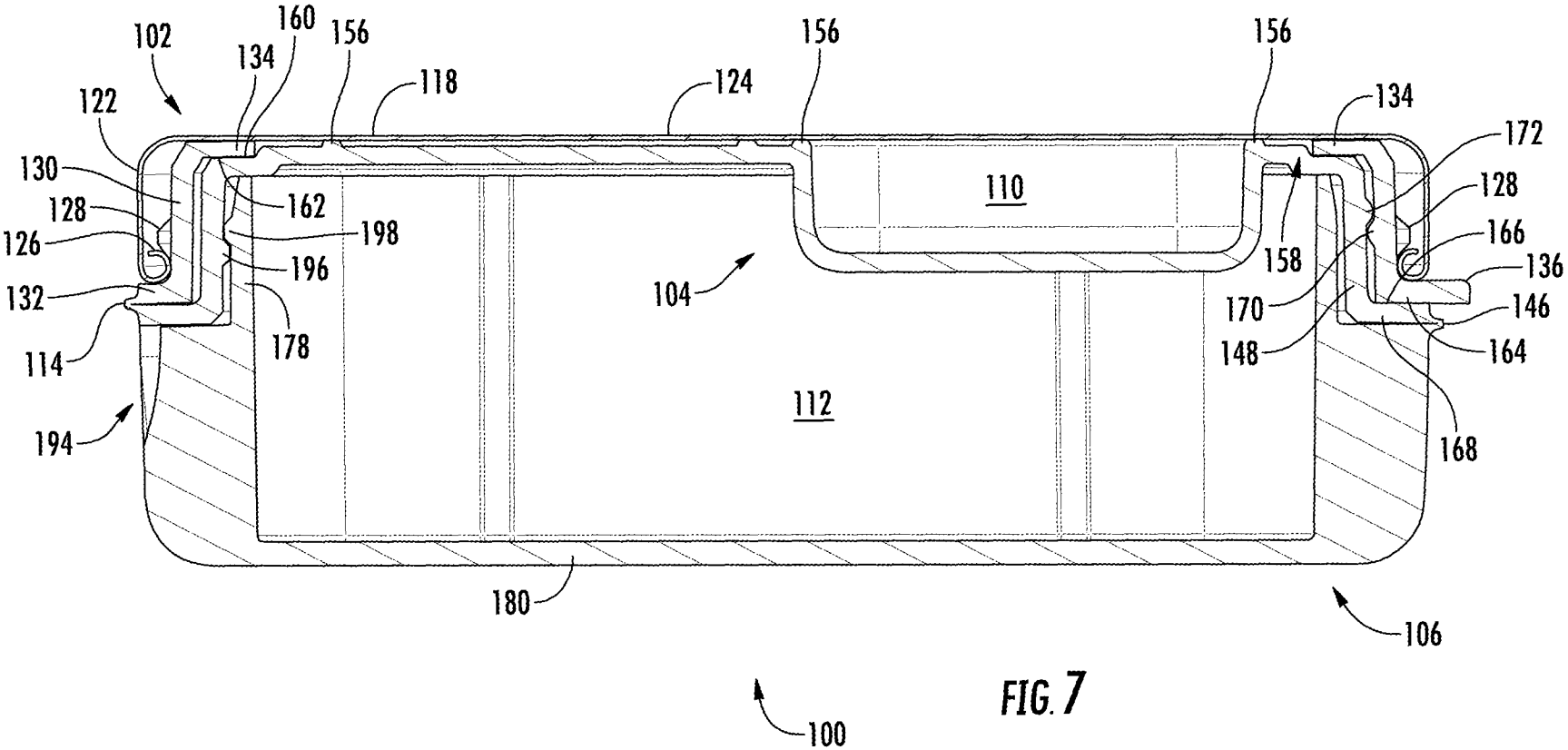
FIGS. 7 and 8 are cross-sectional illustrations taken along line 7,8-7,8 in FIG. 1.

With reference to FIGS. 5 and 7, in the illustrated example, the top wall 150 includes an annular stepped region 154 that includes a pair of annular raised ribs 156. The stepped region 154 and raised ribs 156 extend through the opening 158 bounded by flange 134 of the hinge ring 120 such that the ribs 156 press axially against an inner surface of the lid 102 and particularly an inner surface of the lid cover 120 and even more particularly lid top 124 when the lid 102 is in a closed position relative to the first container body 104.

With continued reference to FIGS. 5 and 7, in the illustrated example, the top wall 150 includes an abutment surface 160 surrounding the stepped region 154. The inner surface 162 of the flange 134 axially abuts/rests on the abutment surface 160 with the inner edge of the flange 134 in generally surrounding relation relative to the stepped region 154.

When in the closed position, the hinge ring 120 and particularly a bottom surface 164 of the flange 132 abuts/rests on an abutment surface 166 of an outward extending flange 168.

The flange 168 extends outward from the sidewall 148 and is at an opposite end of the sidewall 148 as the top wall 150.

Figure 6:
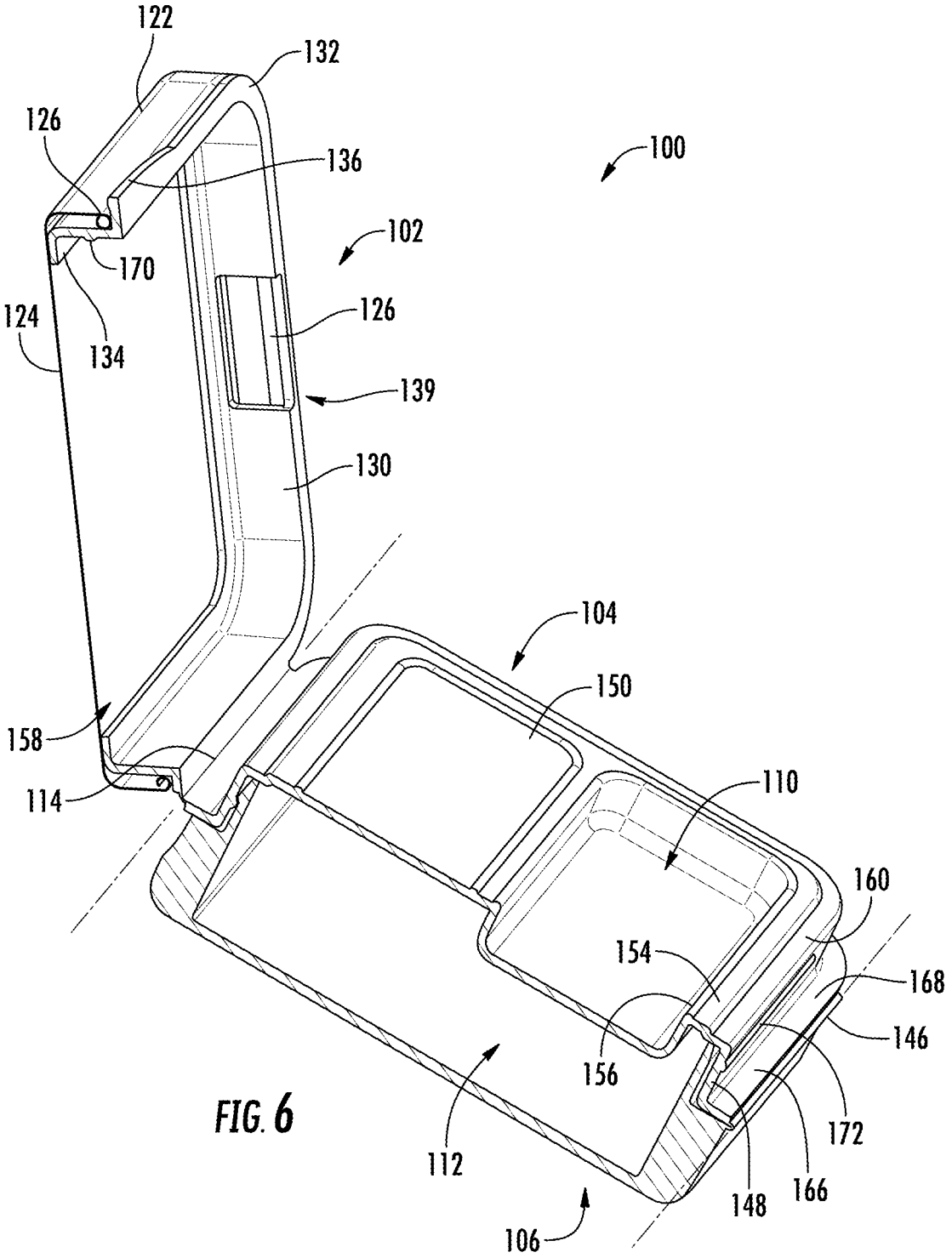
FIG. 6 is cross-sectional illustration taken along line 6-6 in FIG. 5.

With reference to FIGS. 6 and 7, a first catch arrangement is provided between the lid 102 and the first container body 104. The first catch arrangement is provided by a pair of cooperating catches 170, 172. The cooperating catches 170, 172 snap engage one another and secure the lid 102 in the closed position relative to the first container body 104. The engagement force is such that a user can press on finger tab 136 to disengage the first catch arrangement. The first catch arrangement is resilient such that the cooperating catches 170, 172 and/or the components from which they extend undergo resilient deflection to allow for disengagement and engagement.

The catch arrangement provided by catches 170, 172 is located on an opposite side of the container 100 as hinge 114. This is because this catch arrangement opposes pivoting motion of the lid 102 relative to the first container body 104 via hinge 114.

Catch 170 projects inward from sidewall 130 of the lid 102 and catch 172 projects outward from sidewall 148 of the first container body 104.

When the lid 102 is in the closed position, at least a portion of the first container body 104 is received into the annular sidewall 130 of the lid 102. In the illustrated example, at least a portion of the annular sidewall 148 of the first container body 104 is received in the lid 102.

Annular sidewall 148 of the first container body 104 includes openings 174 formed in opposed sides. The openings 174 align with openings 139 when the lid 102 is in the closed position relative to first container body 104 such that access to the exposed portion of the curl 126 is still permitted.

Figure 9:
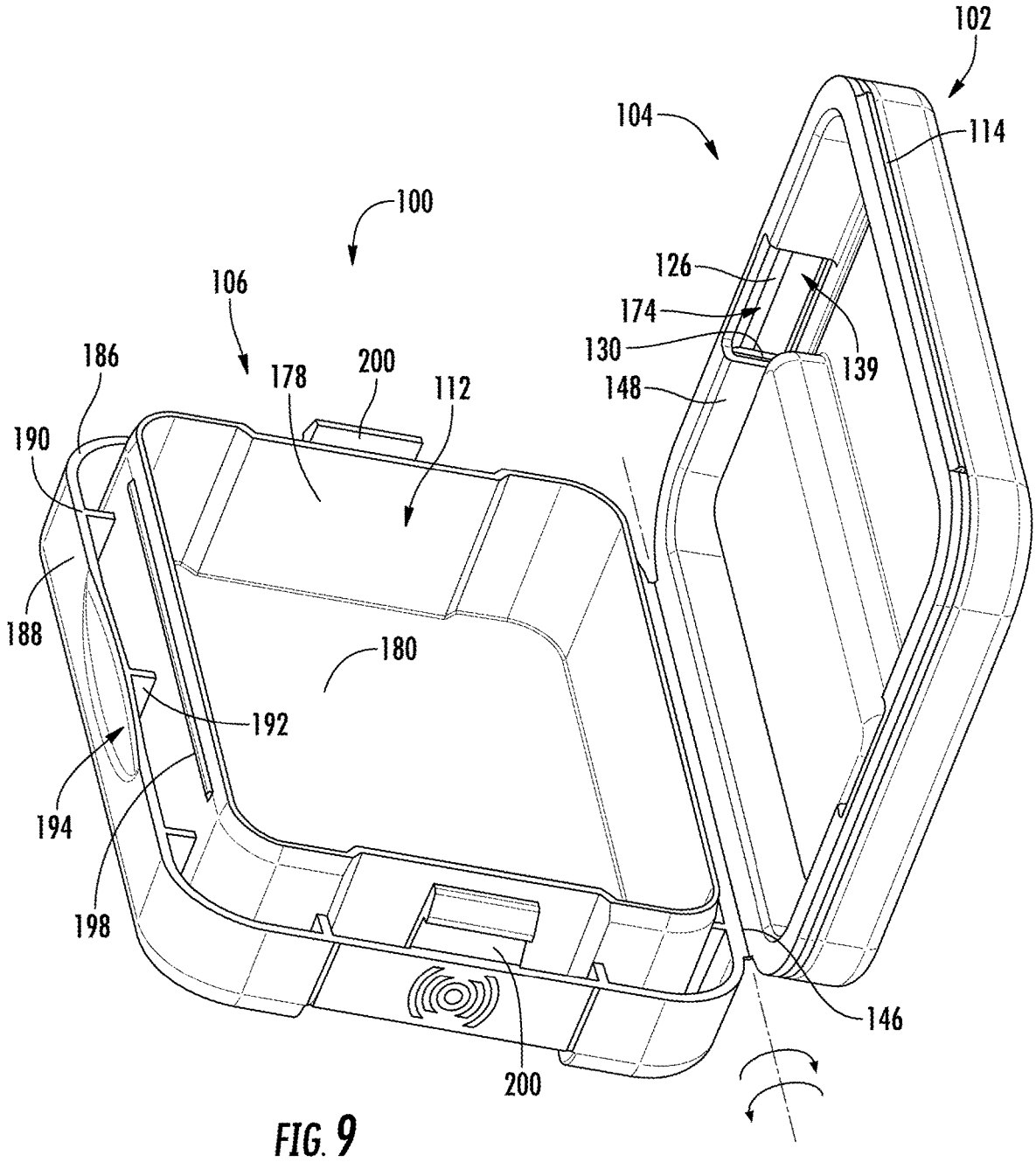
FIG. 9 is a top isometric illustration of the container of FIGS. 1 and 2 with the first container body in an open position relative to the second container body.
Figure 10:
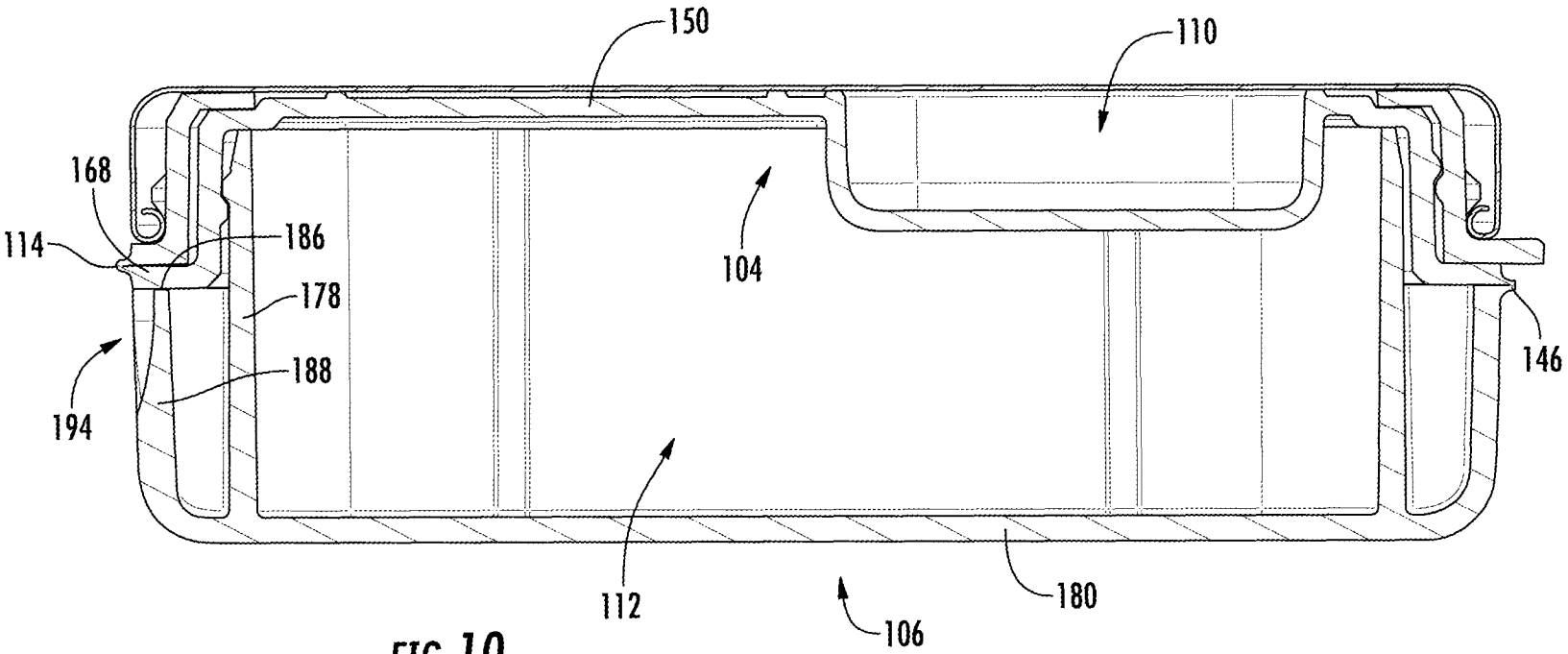
FIG. 10 is a further cross-sectional illustration similar to that of FIGS. 7 and 8 taken along line 10-10 in FIG. 1.

As noted above, the first container body 104 is attached to the second container body 106 by way of the hinge 146. The first container body 104 pivots between a closed position relative to the second container body 106 (FIGS. 1, 2 and 5) and an open position (FIG. 9). In the open position, access to the second storage cavity 112 is permitted. When in the closed position, the first container body 104 prevents access to the storage cavity 112. In one example, the first container body 104 completely closes the storage cavity 112 when in the closed position relative to the second container body 104.

With reference to FIGS. 3 and 9, the second container body 106 includes an inner annular sidewall 178 (also referred to as a "first annular sidewall 178") that extends upward from a bottom wall 180. The bottom wall 180 and the annular sidewall 178 bound the storage cavity 112.

Figure 8:
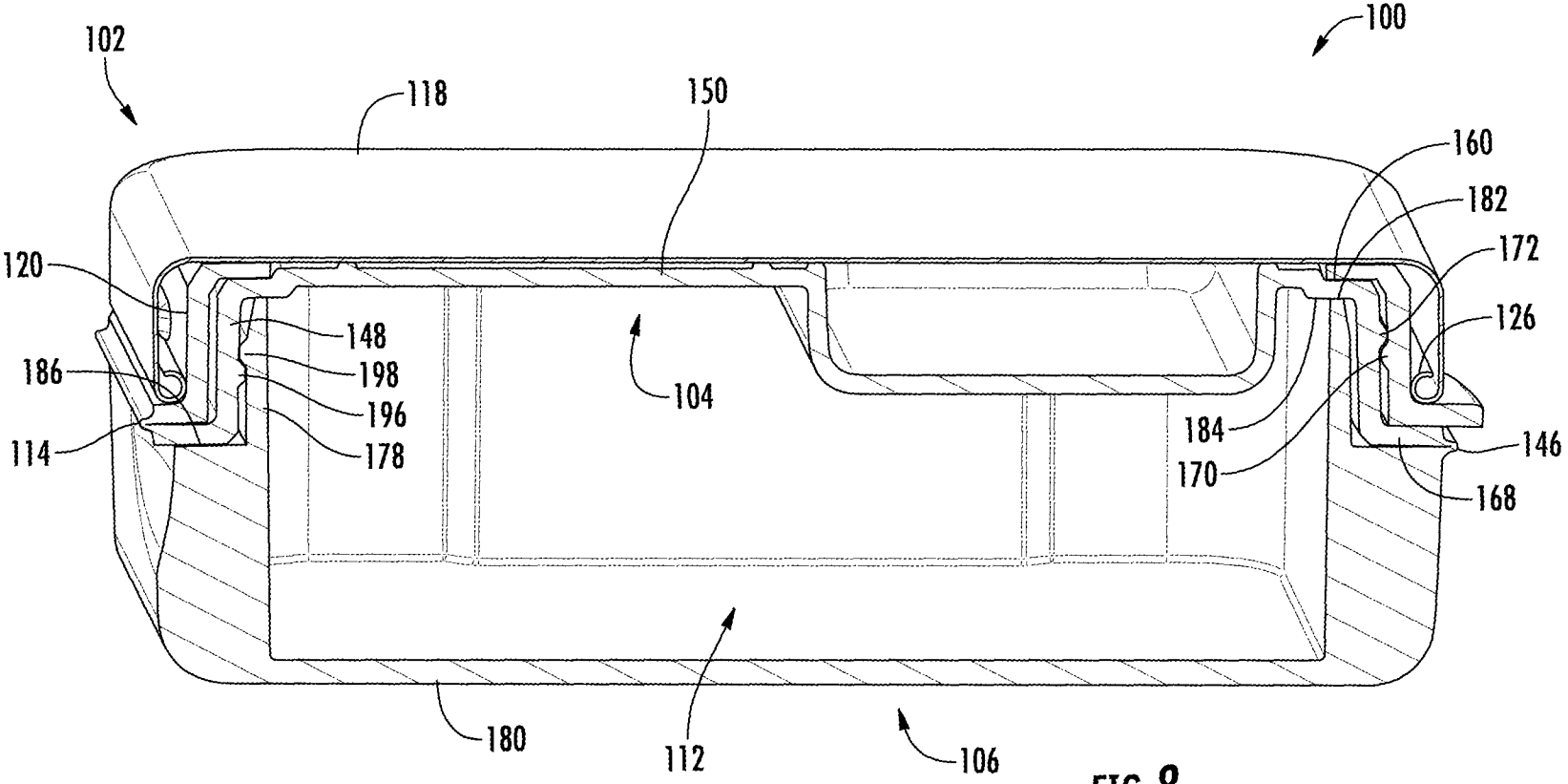

In an example, as illustrated in FIGS. 7 and 8, when the first container body 104 is in the closed position relative to the second container body 106, a portion of the second container body 106 extends into the first container body 104. More particularly, an upper portion of the inner annular sidewall 178 extends axially into the annular sidewall 148 of the first container body 104. Preferably, the free end 182 of the inner annular sidewall 178 axially abuts an inner surface 184 of the top wall 150 of the first container body 104.

In the illustrated example, the inner surface 184 is opposite and generally aligned with the abutment surface 160.

The second container body 106 includes an abutment shelf 186 against which the flange 168 abuts/rests when the first container body 104 is in the closed position. The abutment shelf 186 is positioned laterally outward of the inner annular sidewall 178.

With reference to FIG. 9, the second container body 106 includes a second annular sidewall 188 that is spaced outward from the inner annular sidewall 178. An upper end 190 of the second annular sidewall 188 forms, in part, the abutment shelf 186. The inner and outer annular sidewalls 178, 188 are connected by ribbing 192 that is spaced around the periphery of the inner annular sidewall 178.

The outer periphery of the second annular sidewall 188 generally aligns with the outer periphery of the lid top 118 and outer edges of the outer flanges 132, 168 of the hinge ring 120 and the first container body 104, respectively.

In one example, the outer periphery of one side of the second annular sidewall 188 includes a recess 194 formed therein. The outer flange 168 of the first container body 104 extends outward over the recess 194 such that the underside of flange 168 is partially exposed proximate the recess 194. This arrangement allows a user to press axially on the underside of flange 168 to apply force to transition the first container body 104 from the closed position to the open position relative to second container body 106.

A second catch arrangement is provided between the first container body 104 and the second container body 106. The second catch arrangement is similar to the catch arrangement provided by catches 170, 172 between the lid 102 and the first container body 104.

The second catch arrangement is provided by catches 196, 198 that cooperate and engage to secure the first and second container bodies 104, 106 in the relative closed position. Again, the catch arrangement secures the first and second container bodies 104, 106 relative to one another using snap engagement. The catches 196, 198 and/or the components from which they extend are resiliently flexible to allow for engaging and disengaging. Further, the engagement force therebetween is small enough that a user can disengage the components by pushing on the underside of flange 168 proximate recess 194. Similarly, the user can engage the two catches 196, 198 by pressing the second container body 106 into the first container body 104.

The catch arrangement is on an opposite side of the container 100 as the hinge 146.

In addition to the catch arrangements provided by cooperating catches 170,172 and 196, 198, the container 100 includes a latch arrangement for providing greater amount of latching than the catch arrangements previously discussed. The latch arrangement includes a pair of latches 200. While a pair of latches 200 are illustrated, in other examples, only a single latch 200 is required.

Figure 11:
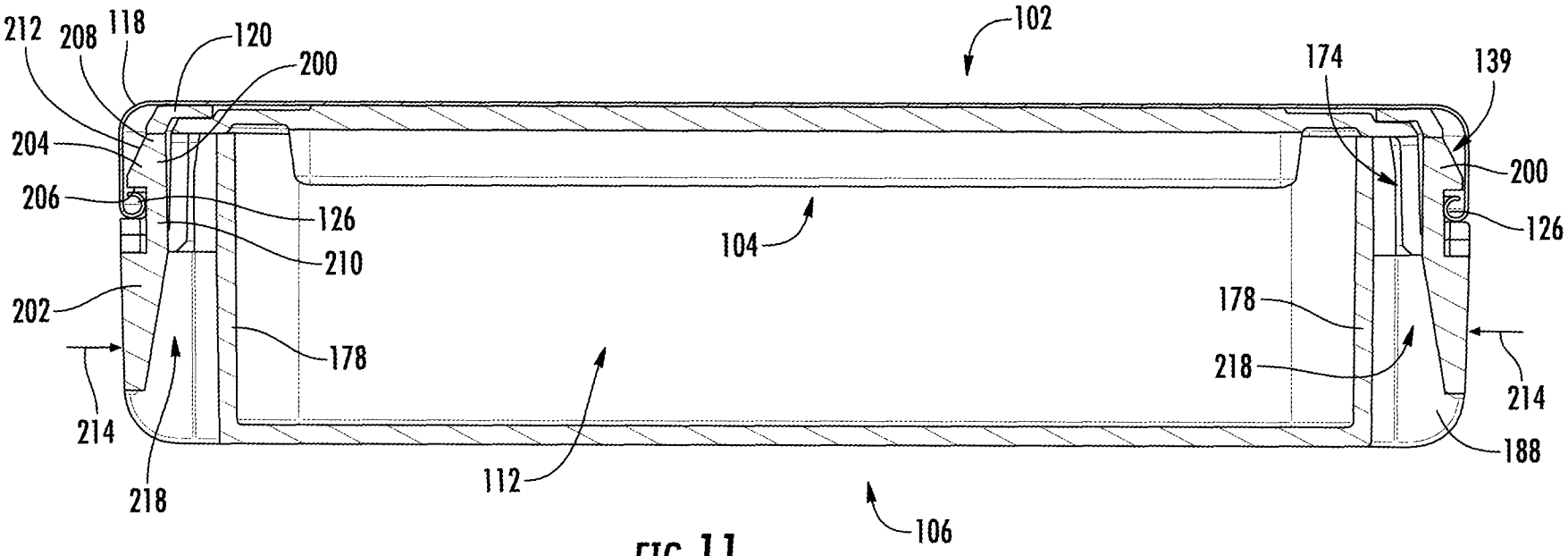
FIG. 11 is a cross-sectional illustration of the container of FIGS. 1 and 2 taken along line 11-11 in FIG. 1.

With additional reference to FIG. 11, the latches 200 engage lid 102 and particularly curl 126 of lid cover 118.

While multiple latches 200 are illustrated, for simplicity, only one of the latches 200 will generally be described.

The latch 200 includes an attachment region 202 that carries a catch 204 that includes an abutment surface 206. Abutment surface 206 axially engages curl 126. The catch 204 includes a head portion 208 that is attached to the attachment region 202 by a neck portion 210.

The head portion 208, in this example, is tapered and includes tapered surface 212. The tapered surface 212 assists in transitioning the container 100 from the various open positions to the fully closed position. More particularly, the tapered surface 212 allows the head portion 208 of the latch 200 to be biased inward toward the inner annular sidewall 178 as the head portion 208 slides past the curl 126.

The attachment region 202 is connected to the second container body 106 and particularly to the second annular sidewall 188, by a pair of weakened areas 216 to facilitate resilient flexure of the attachment region 202 upon application of a pinching force 214. A relief 218 is provided between the latch 200 and the inner annular wall 178 allows for inward motion of the latch 200 upon application of the pinching force 214.

Upon application of the pinching force 214, the latch 200 moves inward towards the inner annular sidewall 178. In this example, the latch 200 moves generally parallel to the hinges 114, 146.

In other examples, the latch 200 may act under a pivoting motion.

When in the closed position, the apertures 139 and 174 of the hinge ring 120 and the first container body 104 align. This allows the latch 200 to access and engage the curl 126. When the pinching force 214 is applied, head portion 208 and the abutment surface 206 retract inward releasing the lid 102. Similarly, when the pinching force 214 is released, the latch 200 will return to a default position. The default positon is illustrated in FIG. 11. FIG. 5 illustrates that the latch 200 is accessible through opening 174.

The latch 200, in this example, is located within a gap 220 formed in the second annular sidewall 188.

The engagement between the latches 200 and the lid 102 will typically be greater than the engagement between first catch arrangement provided by the catches 170, 172 and the second catch arrangement provided by the catches 196, 198. This is because the latches 200 are used for securing the container 200 in the closed position, such as when the container 100 is in the user's pocket. However, the other catch arrangements are used for lighter securement of the lid 102 and first container body 104 in the closed positions to avoid undesirable/unexpected spillage of the contents of the container 100 when the latches 200 are depressed or being depressed.

In operation, the second storage cavity 112 (see e.g. FIG. 3), will be used to store unused product while the first storage cavity 110 (see e.g. FIG. 4) will be used for waste material. For example, unused tobacco packets or unchewed gum could be stored in storage cavity 112 while used tobacco packets or chewed gum could be stored in first storage cavity 110.

This allows a user to store the waste product when waste disposal is not available. This finds particular benefit when the waste product (e.g. used tobacco pack or chewed gum) has moisture that makes it undesirable to put the waste material directly in the user's pocket.

The container 100 may be considered child resistant because it requires multiple actions to open the container 100. More particularly, the user must compress the latches 200 as well as disengage the catch arrangements formed by the catches 170, 172 and the catches 196, 198.

In the illustrated example, the user pivots the lid 102 and first container body 104 in opposite directions about the hinges 114, 146, respectively, when transitioning between the corresponding open and closed positions.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the present disclosure (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the present disclosure and does not pose a limitation on the scope of the present disclosure unless otherwise claimed. No language in the specification should be construed as indicating any non-claimed element as essential to the practice of the present disclosure.

Preferred examples of this present disclosure are described herein, including the best mode known to the inventors for carrying out the present disclosure. Variations of those preferred examples may become apparent to those of ordinary skill in the art upon reading the foregoing description. The inventors expect skilled artisans to employ such variations as appropriate, and the inventors intend for the present disclosure to be practiced otherwise than as specifically described herein. Accordingly, this present disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A container comprising:

a lid;

a first container body connected to the lid by a first hinge for pivoting the lid relative to the first container body between a lid closed position relative to the first container body and a lid open position relative to the first container body, the first container body defining a first storage cavity;

a second container body connected to the first container body by a second hinge for pivoting the first container body relative to the second container body between a first container body closed position relative to the second container body and a first container body open position relative to the second container body, the second container body defining a second storage cavity; and a first latch attached to the second container body, the first latch being transitionable between a latched position in which the latch engages the lid and prevents pivoting of the lid about the first hinge or the first container body about the second hinge and an unlatched position in which the first latch is disengaged from the lid such that the first latch does not prevent the lid from pivoting relative to the first container body and such that the first latch does not prevent the first container body from pivoting relative to the second container body.

2. The container of claim 1, wherein the first and second hinges are parallel to one another and transversely spaced apart.

3. The container of claim 1, wherein the lid includes a plastic hinge ring and a metal cover snap attached to the plastic hinge ring;

the first and second container bodies being formed from plastic; and the first and second container bodies, the first and second hinges, and the plastic hinge ring being formed from a single continuous piece of plastic.

4. The container of claim 1, further comprising:

a first catch arrangement between the lid and the first container body securing the lid in the lid closed position relative to the first container body when the first latch is in the unlatched position, the first catch arrangement being disengageable by a user pressing on the lid and providing an angular torque about the first hinge; and a second catch arrangement between the first container body and the second container body securing the first container body in the first container body closed position relative to the second container body when the first latch is in the unlatched position, the second catch arrangement being disengageable by a user pressing on the first container body and providing an angular torque about the second hinge.

5. The container of claim 4, wherein:

the first latch provides a greater latching force when in the latched position than the first catch arrangement provides between the lid and the first container body; and the first latch provides a greater latching force when in the latched position than the second catch arrangement provides between the first container body and the second container body.

6. The container of claim 4, wherein the first catch arrangement is a snap engaging catch arrangement and the second catch arrangement is a snap engaging catch arrangement.

7. The container of claim 1, wherein when the first container body is in the first container body closed position relative to the second container body, access to the second storage cavity is prohibited by the first container body if the lid is in the lid open or lid closed positions.

8. The container of claim 1, wherein the first storage cavity has a smaller volume than the second storage cavity.

9. The container of claim 1, wherein:

the lid includes a first annular sidewall;

the first container body includes a second annular sidewall;

the second container body includes a third annular sidewall;

at least a portion of the second annular sidewall extends into the first annular sidewall when the lid is in the lid closed position relative to the first container body; and at least a portion of the third annular sidewall extends into the second annular sidewall when the first container body is in the first container body closed position relative to the second container body.

10. The container of claim 9, wherein:

the lid includes a lid top, the first annular sidewall extending outward from the lid top;

the first container body includes a first top wall, the second annular sidewall extending outward from the first top wall, the first top wall including a recess forming the first storage cavity;

the second container body including a bottom wall, the third annular sidewall extending outward from the bottom wall, the bottom wall and third annular sidewall defining the second storage cavity.

11. The container of claim 1, wherein the first latch is formed as a continuous piece of material with the second container body and the first latch resiliently flexes relative to the second container body to transition between the latched and unlatched positions.

12. The container of claim 11, wherein the first latch moves generally parallel to the first and second hinges when transitioning between the latched and unlatched positions.

13. The container of claim 1, further comprising a second latch being substantially identical to the first latch, the first and second latches being moved towards one another to transition the first and second latches to the unlatched positions thereof from the latched positions.

14. The container of claim 9, wherein the second annular sidewall has an opening therethrough, the latch extending through the opening in the latched position to engage the lid.

15. The container of claim 3, wherein the metal cover has an annular sidewall terminating in a curled end, the latch engaging the curled end in the latched position, the curled end engaging a catch of the plastic hinge ring to snap engage the metal cover to the plastic hinge ring.

16. A method of using a container of claim 1, the method comprising:

transitioning the latch to the unlatched position; and pivoting the lid relative to the first container body to the lid open position relative to the first container body from the lid closed position relative to the first container body or pivoting the first container body to the first container body open position relative to the second container body from the first container body closed position relative to the second container body.

17. A method of using a container of claim 1, the method comprising:

transitioning the latch to the unlatched position;

pivoting the lid relative to the first container body to the lid open position relative to the first container body from the lid closed position relative to the first container body when the first container body is in the first container body closed position relative to the second container body; and pivoting the first container body to the first container body open position relative to the second container body from the first container body closed position relative to the second container body when the lid is in the lid closed position relative to the first container body.

* * * * *